United States Patent [19]

Young

[11] Patent Number: 4,706,938

[45] Date of Patent: Nov. 17, 1987

[54] OFFSET WHEEL BRACKET ASSEMBLY

[76] Inventor: Michael C. Young, 1407 Union Valley Rd., West Milford, N.J. 07480

[21] Appl. No.: 733,908

[22] Filed: May 14, 1985

[51] Int. Cl.[4] ..... B66F 7/10

[52] U.S. Cl. ..... 254/133 R; 254/DIG. 4

[58] Field of Search ..... 254/133 R, 1, 100, 134, 254/DIG. 4

[56] References Cited

U.S. PATENT DOCUMENTS

| | | | |
|---|---|---|---|
| 2,063,060 | 12/1936 | Sheety | 254/133 R |
| 2,288,097 | 6/1942 | Lucker | 254/133 R |
| 2,524,916 | 10/1950 | Loos | 269/97 |
| 3,873,065 | 3/1975 | McCann | 254/100 |
| 3,892,385 | 7/1975 | Andrist et al. | 254/133 R |

*Primary Examiner*—Frederick R. Schmidt
*Assistant Examiner*—Judy J. Hartman
*Attorney, Agent, or Firm*—Polster, Polster & Lucchesi

[57] ABSTRACT

A vehicle wheel offset wheel bracket assembly includes a platform with a jack receiving surface, and wheel rim engaging arms, connected to and extending upwardly and outwardly from the platform toward a wheel to be raised, for engaging an under surface of an upper part of a rim of a wheel to be raised. The platform projects in a direction away from the wheel and a restraining chain, connected to the platform and to the lower part of the wheel keeps the platform from moving outwardly away from the wheel when a jack is raised against the platform.

12 Claims, 9 Drawing Figures

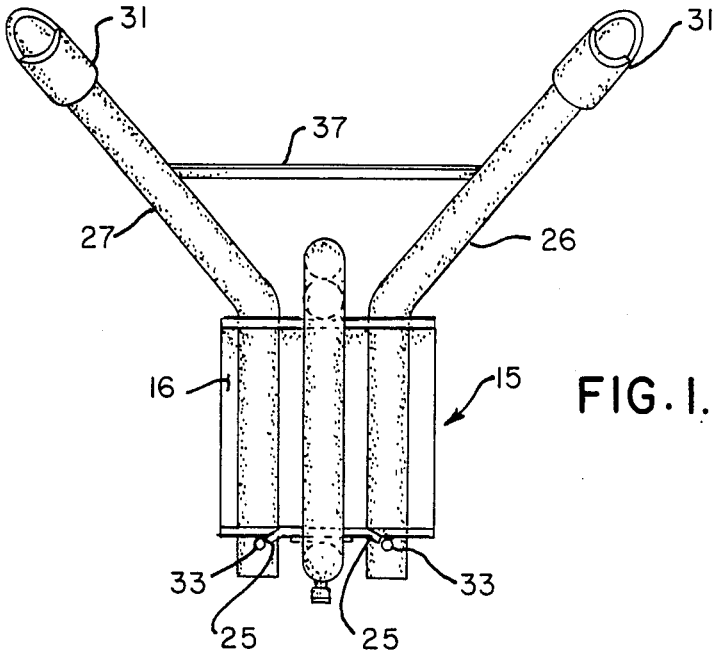
FIG. 1.
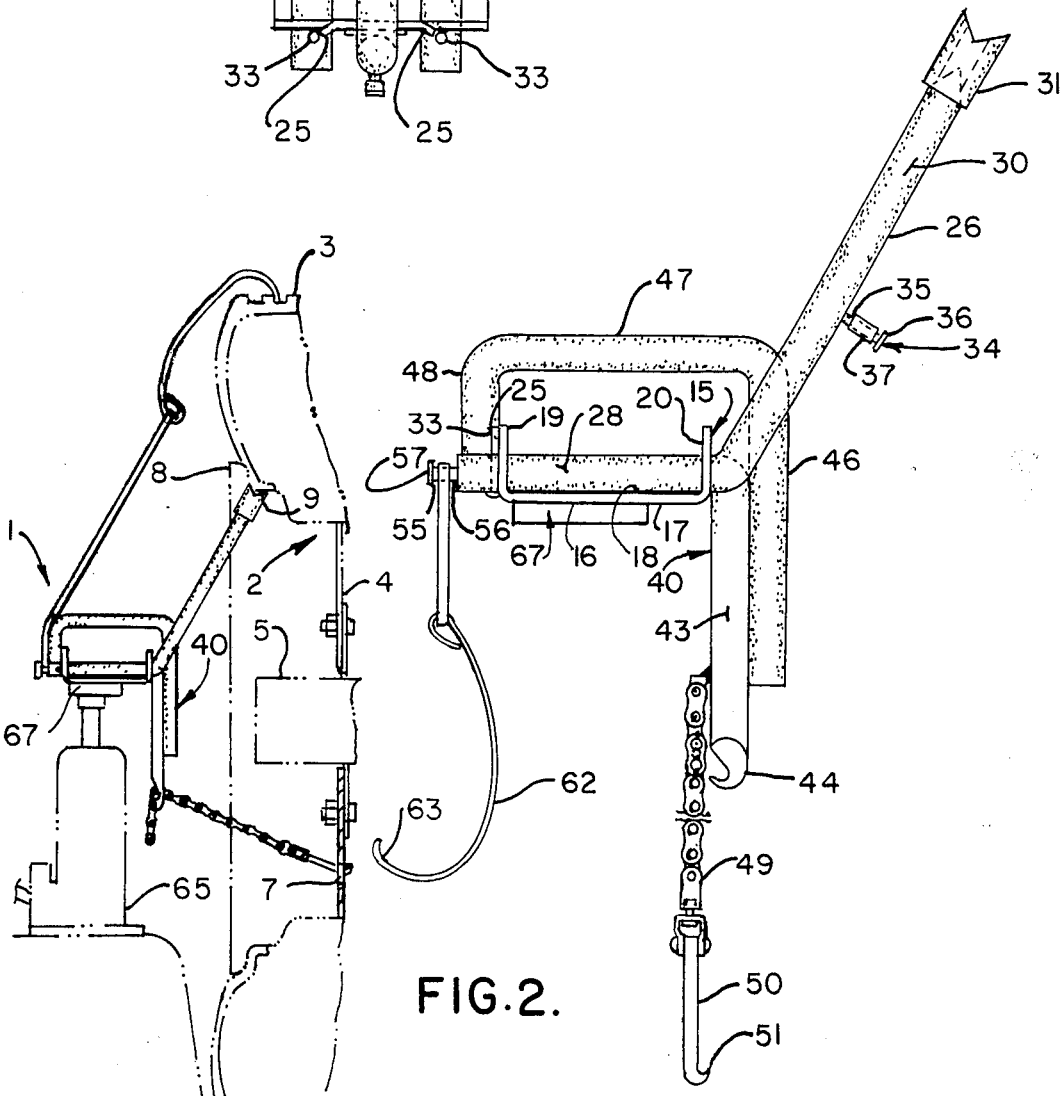
FIG. 2.
FIG. 9.

OFFSET WHEEL BRACKET ASSEMBLY

BACKGROUND OF THE INVENTION

The offset wheel bracket assembly of this invention has particular utility in two situations: To extricate a two or four-wheel drive vehicle from mud or from a rut which has permitted the frame or axles of the vehicle to hang up between the wheels, and to permit changing flat tires on a vehicle, such as some sport cars, that has so little clearance from the ground as to make positioning a jack under the frame difficult without lying down on the ground. These are not the only uses for the device, but they are important ones.

When, in the course of traveling unmade roads or trails such as may be traversed by hunters, loggers, miners or military drivers, a two and four-wheel drive vehicle gets stuck in the mud or hung up on a high spot between ruts, it is often only necessary to get a rock or some other support under one front wheel, to permit the wheel to be turned at an angle to the rut to permit the vehicle to climb onto the crown between the ruts and extricate itself. However, it is no easy matter to get a jack under the frame to lift the wheel high enough to get a rock under it. A bumper jack raises the frame, but the wheel is likely to remain mired. The usual screw jack cannot be put into place unless a trench is dug to the place at which it has to be positioned, and in such a way that the jack handle can be manipulated.

The problems of trying to change a tire on a car or light truck with little clearance, using the screw or scissors type jacks commonly provided, when one is in good clothes, are self evident.

One of the objects of this invention is to provide an offset wheel bracket assembly by the use of which a wheel can be jacked up easily and quickly.

Another object is to provide such a wheel bracket assembly which is economical to manufacture, sturdy and durable in use.

Other objects will become apparent to those skilled in the art in the light of the following description and accompanying drawings.

SUMMARY OF THE INVENTION

In accordance with this invention, generally stated, an offset wheel bracket for use in jacking up a vehicle wheel includes a platform having a jack-receiving surface, and wheel rim engaging means connected to and extending upwardly and outwardly from the platform toward a wheel to be raised for engaging an undersurface of an upper part of a rim of the wheel. The platform projects in a direction away from the wheel. Restraining means connected to the platform and connected to the web of the wheel at an opening therein, restrains the platform from moving outwardly away from the wheel when a jack is raised against the underside of the platform. In the preferred embodiment, the wheel rim engaging means takes the form of a pair of arms pivoted to the platform and extending upwardly and outwardly away from the platform toward a wheel to be raised. The arms are of a length to position the undersurface of the platform at substantially the level of the axis of rotation of the wheel, the center of the usual axle hub projecting through the wheel, or slightly above it and their angularity is such as to hold the platform clear of the axle hub outboard of the hub. The arms diverge from one another in the direction away from the platform and are limited in their movement toward one another by stops, most conveniently provided on the platform.

In this embodiment, the restraining means includes a roller type chain mounted on a depending chain support with a chain engaging hook at its lower end. At the lower end of the chain, a wheel-engaging hook is mounted to connect the chain to the wheel web. The chain engaging hook of the support is used to take a sufficient hitch in the chain to take out the slack when the wheel engaging hook has been put in position and to position the platform perpendicular to the wheel. The chain support is pivotly mounted on the platform on a pivot axis generally aligned with or parallel to the axis of rotation of the wheel.

In one embodiment, a stand is provided for holding the platform in raised position to permit the removal of a jack to permit its use in the conventional way, and to permit the removal of the stand and wheel bracket assembly when the vehicle is raised further.

BRIEF DESCRIPTION OF THE DRAWINGS

In the drawing, FIG. 1 is a top plan view of one embodiment of wheel bracket assembly of this invention;

FIG. 2 is a view in side elevation of the wheel bracket assembly of FIG. 1;

FIG. 9 is a view in side elevation, partly broken away, illustrating the wheel bracket assembly in use.

DESCRIPTION OF THE PREFERRED EMBODIMENT

Figure 3:
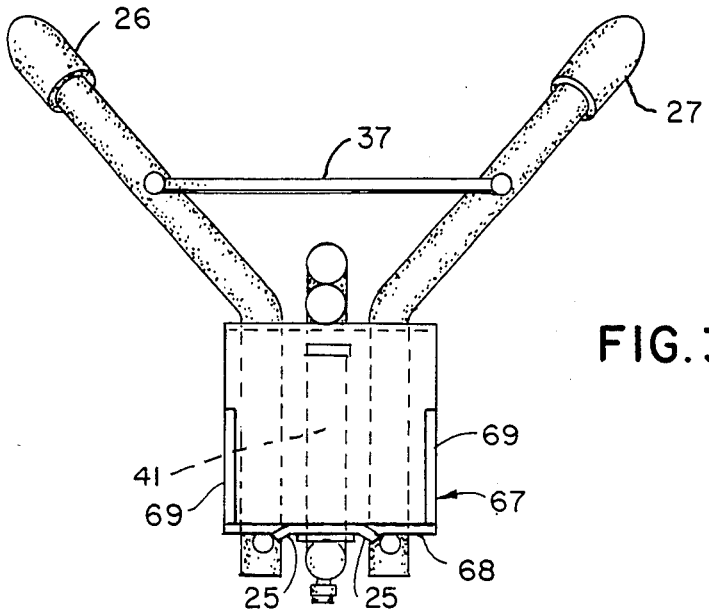
FIG. 3 is a bottom plan view.

Referring now to the drawing and particularly to FIGS. 1 through 4 and 9, reference numeral 1 indicates one embodiment of offset wheel bracket assembly of this invention. As shown particularly in FIG. 9, the wheel bracket assembly 1 is intended for use with a wheel 2 of a vehicle, which is not here illustrated. The wheel 2 has the usual pneumatic tire 3 mounted on it. The wheel itself has a web 4 with a central opening through which a hub 5 of an axle, not here shown, projects.

At its outer periphery, the web 4 is formed to provide a rim 8, with an undersurface 9. A short distance radially inboard of the rim 8, the web is provided with vent openings 7, concentric with the rim and spaced apart evenly around the wheel.

In this embodiment, the wheel bracket assembly includes a platform 15, with a central plate 16. The plate 16 has a lower, flat, jack-receiving surface 17, and an upper, flat surface 18, an outer flange 19 that extends from an outer edge of the flat surface 17 substantially perpendicularly upwardly from the flat surfaces 17 and 18 and an inner flange 20 that extends substantially perpendicularly upwardly from the surfaces 17 and 18 at an inner edge of the plate 16. A jack-head cage 67 is secured to the lower flat surface 17. In this embodiment, the cage 67 consists of an outer wall 68 and two side walls 69, the function of which is to keep the jack-head from sliding outwardly or to one side from the platform in use.

Each of the flanges 19 and 20 has three openings through it, a central, wheel hook bar opening 21, and, symmetrically spaced on either side of the central opening 21, arm openings 22 and 23. The openings in the two flanges are aligned on lines perpendicular to the flanges 19 and 20.

In this embodiment, stops 25 are lanced from the outer flange 19, to project outwardly from the plane of the outer surface of the flange, both of the stops 25 facing away from the center of the flange.

In this embodiment, upper rim engaging means consist of arms 26 and 27, round in tranverse cross section, and removable adapter sleeves 31. Each of the arms 26 and 27 has a straight pivot section 28, journaled in and extending through the openings 22 and 23 respectively in the outer and inner flanges 19 and 20, and an angled section 30 on the free ends of which the sleeves 31 are mounted. In this embodiment, the free ends of the angled sections are tapered, and the sleeves are sized internally to fit on the tapered portion.

At the outer ends of the straight pivot sections 28, on the outer side of the outer flange 19, each of the arms is provided with a heavy stop pin 33. The stop pins 33 serve both to prevent axially shifting of the arms inwardly, in a direction toward the wheel, and, importantly, serve, by abutting the stops 25, to limit the movement of the angled sections 30 of the arms toward one another, as shown particularly in FIGS. 1 and 4. A washer, pin, shoulder or the like can be provided on the straight sections 28 to prevent axial movement of the arms outwardly, as well.

In this embodiment, posts 34, each with a shank 35 and a head 36, are secured to the inner side of the angled sections 30, and an elastic band 37 is stretched between them to hold the angled sections 30 in position with the pins 33 against the stops 25 for facilitating the use of the assembly. As can be appreciated, the arms can be rotated against the bias of the band 37 in a direction outboard of the platform until the band 37 overcenters to hold the angled sections in a storing position below the level of the platform.

In this embodiment, a wheel hook bar 40 has a straight pintle reach 41 journaled in and extending beyond the hook bar openings 21, and a depending bar section 43, bent at right angles to the pintle section 41, and terminating at its lower end in an outwardly directed catch hook 44. In this particular embodiment, a reinforcing handle member 45 is provided, with a reinforcing leg 46 parallel to and welded to the inner surface of the bar section 43, a handle portion 47 extending over, parallel to, and beyond the upper surface 18 of the central plate 16 of the platform 15, and a short vertical outer leg 48, welded, beyond the outer surface of the outer flange 19, to an outer end of the pintle reach 41.

A roller chain 49 is welded at one end to the outside surface of the depending bar section 43 above the hook 44, and in such a way that the chain hangs parallel to the bar section 43, and is aligned with the hook 44 so that the hook 44, which is made thin relative to the bar section 43, can project between rollers to hold the chain, as is explained hereinafter.

Figure 4:
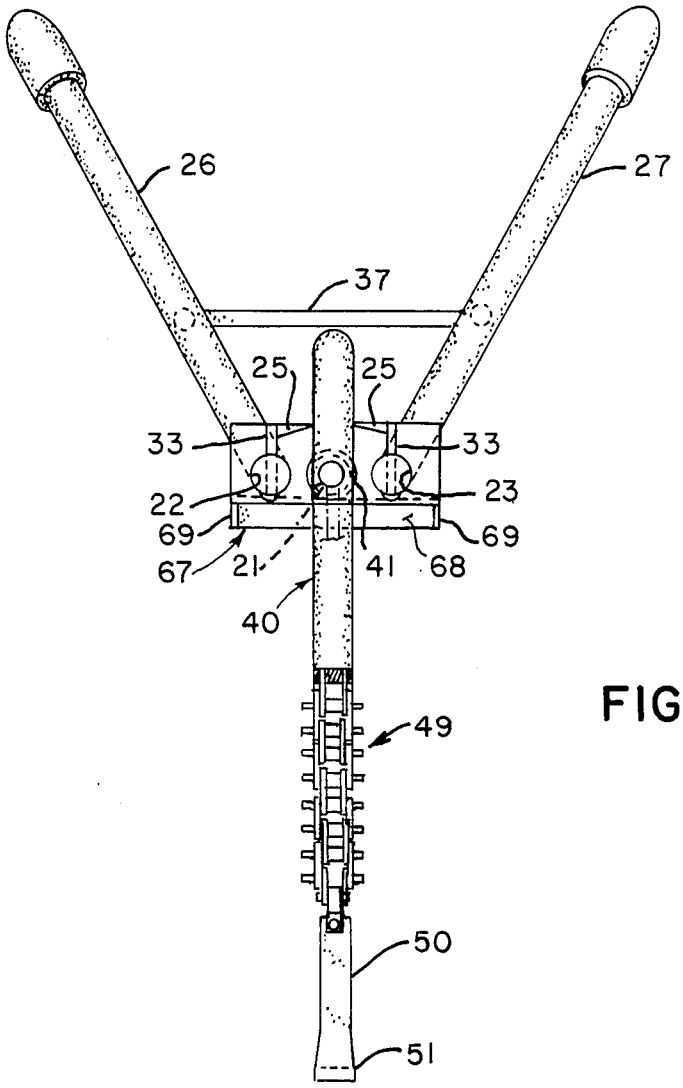
FIG. 4 is a rear elevational view in the direction from left to right of FIG. 2.

A wheel web hook 50 with a broad lip 51 as compared with the hook 44, as shown particularly in FIGS. 2 and 4, is mounted on a swivel 52 connected to the lower end of the chain 49. The lip 51 is directed inwardly toward the wheel.

A temporary platform support assembly in this embodiment consists of a post 55, with a shank 56 and a head 57, an elastic band 60 mounted on the shank 56, and a tire grapple 61, made up of a curved shaft 62 and a sharp hook 63.

In the operation of the wheel bracket assembly of this embodiment, as illustrated particularly in FIG. 9, the hook 63 of the tire grapple is hooked into the tread of the tire. The elastic band 60 is sized to support the outer end of the platform. The angled sections of the arms 26 and 27 are swung to the position shown in FIGS. 1 through 4, and the sleeves 31, which in this embodiment are notched to engage a rim shaped complementarily to the notch, are placed against the undersurface 9 of the rim 8. The angled sections of the arms 26 and 27, with the sleeves 31 mounted on them, are of such a length as to bring the lower flat surface of the platform 15 on substantially a line with the axis of rotation of the wheel. If there is to be any variation, it should be on the side of having the lower surface of the platform slightly above that axis, rather than below it. The length of the angled sections and their angularity are such as to hold the platform an inch or so outboard of the hub 5. The lip 51 of the web hook 50 is hooked around an edge of the web defining one of the openings 7 most nearly immediately below the depending bar section 43 and chain 49, and any slack in the chain 49 is taken up to make the platform central plate substantially horizontal, by hooking the appropriate roller over the hook 44. Because the wheel hook bar is pivoted, the reach of the chain from the web hook 50 to the bar section 43 will be straight and aligned with the bar section 43, even though the web opening may be offset from the vertical with respect to the pintle sectional. In the illustration in FIG. 9, a screw type jack 65 is positioned under the platform and raised until the head of the jack engages the undersurface 17 of the platform within the compass of the cage 67. Continued raising of the jack screw will cause the wheel to move upwardly directly, as distinguished from the action of a bumper jack, for example, which merely raises the body and, depending upon the springing and the miring of the wheel, may not raise the wheel at all. When the wheel, hence the vehicle, is raised enough to give even slight clearance from the surface on which the vehicle is hung up, it is generally only necessary to put a rock or some other supporting surface under the tire, remove the wheel bracket assembly and jack, turn the wheel, and drive the vehicle out. If the wheel bracket assembly is to be used for only one size wheel, with a particular, known rim configuration and diameter, the adapter sleeves 31 may be eliminated. However, by providing adapter sleeves of different lengths so that the effective lengths of the angled sections 30 of the arms 26 and 27 can be varied to ensure that the lower surface 17 of the platform is at or immediately above the axis of rotation of the wheel and outboard of the hub, and by providing various types of notches where desirable, the device is made more versatile.

Figure 5:
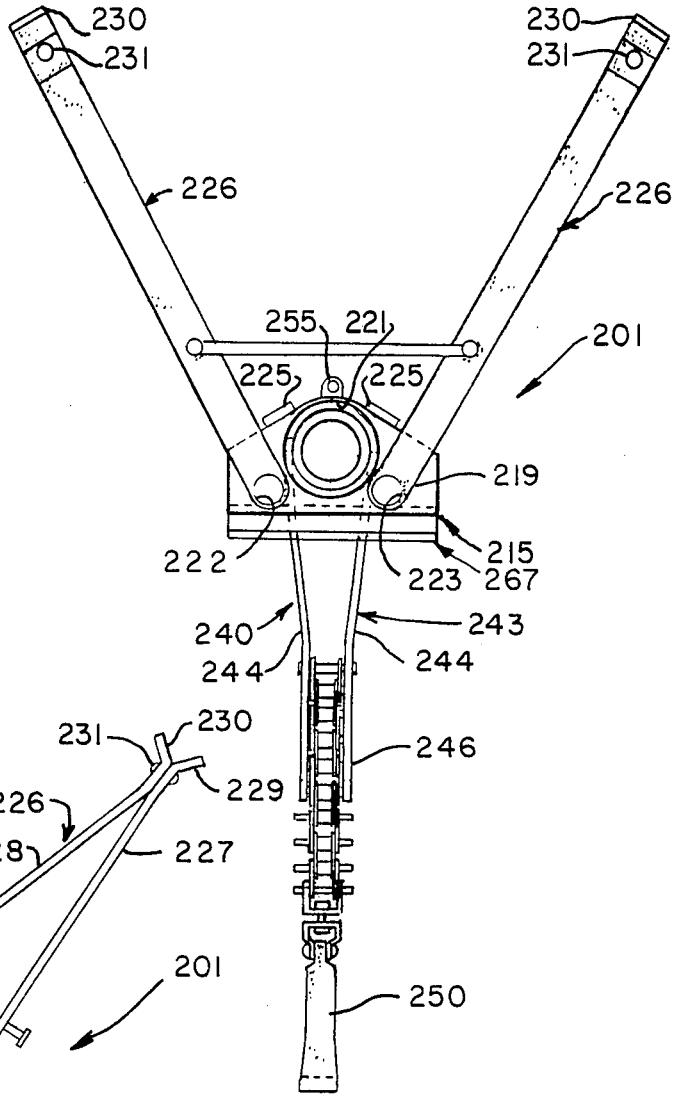
FIG. 5 is a rear elevational view of another embodiment of wheel bracket assembly of this invention.
Figure 6:
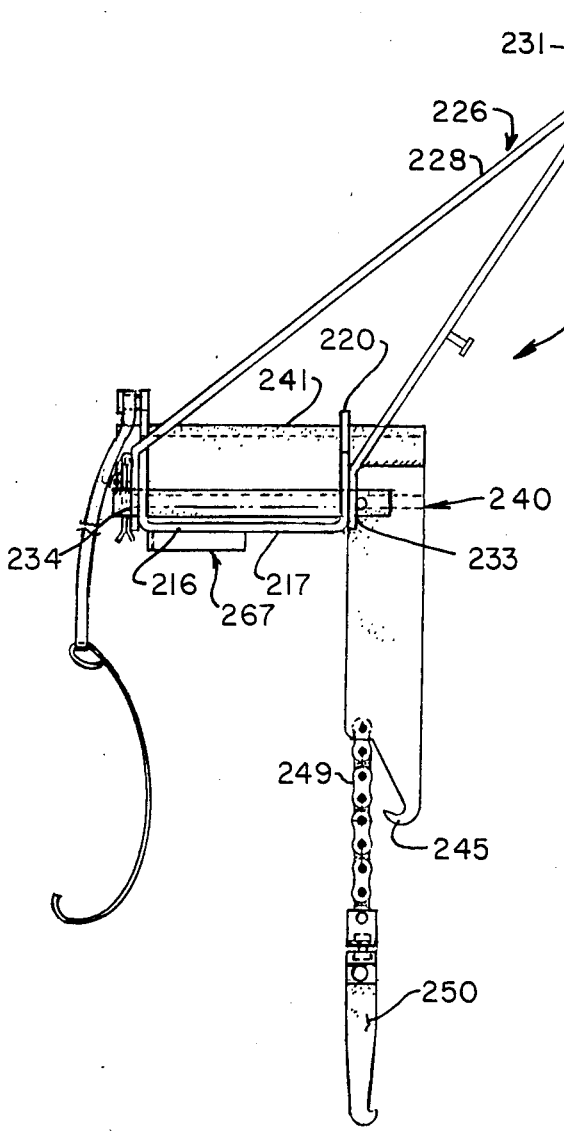
FIG. 6 is a view in side elevation of the assembly of FIG. 5.

Referring now to FIGS. 5 and 6 for another embodiment of wheel bracket assembly of this invention, reference numeral 201 indicates the completed assembly, which includes a platform 215 with a central plate 216 and a lower, jack-receiving flat surface 217, an outer flange 219 and an inner flange 220, all corresponding to similarly numbered elements of the assembly described heretofore. In this embodiment, the inner and outer flanges are made higher in the center than at the outboard edges of the flanges, to accommodate a relatively large hookbar opening 221, flanked on either side by smaller arm openings 222 and 223. Stops 225 in this embodiment take the form of tabs integral with the upper edge of the outer flange 219.

In this embodiment, two arms 226 are each made up of an inner strap 227 and an outer strap 228. The inner strap 227 has a lip 229 bent downwardly at the outer end of the strap, and strap 228 has a lip 230 bent upwardly at the end of the strap. The two straps are connected, in this illustrative embodiment, with a rivet 231 adjacent the roots of the lips 229 and 230. The inner strap 227 extends to the inner base of the inner flange 220, where it is bent to form a pintle-engaging section parallel to the inner surface of the flange 220 and immediately adjacent it. The outer strap 228 extends over and beyond the outer flange 219 and has a pintle engaging section bent to extend parallel to and immediately adjacent the outer surface of the outer flange 219. The arms are mounted on a pintle 236, journaled in the arm openings 222 and 223 and projecting at either end beyond the respective flanges. The arms can be mounted to the pintle in any suitable way. They are shown in the drawing as connected to the pintle by providing openings in the sections 233 and 234 to embrace the pintle, and providing cotter pins to cage the sections 233 and 234 between them and the adjacent faces of the flanges. They could be welded, but would not then be removable.

In this embodiment, a wheel hook assembly 240 consists of a heavy cylindrical pivot shaft 241, journaled in the hook bar openings 221 and extending beyond them at either end, a wheel hook chain bracket 243, a roller chain 249 and a web hook 250, connected to the chain by a swivel. The chain bracket 243 in this embodiment consists of two bar straps 244 welded to diametrically opposite sides of a projecting inner end of the shaft 241, and bent to form a parallel sided chain channel section 246, terminating at their lower ends in a pair of chain hooks 245 positioned, as shown in FIG. 6, at the inner side of the straps 244. Near the outer side, above the hooks 245, the chain 249 is mounted in the channel defined between the channel sections 246. In this embodiment, the chain 249 is made with link pins that project a substantial distance beyond the side links of the chain, as shown particularly in FIG. 5. These provide a ready means of engagement with the hooks 245.

A tire grapple assembly is the same as the one illustrated and described in the first embodiment, except that in this embodiment, the elastic band is mounted on or in an eye 255 secured to or made integral with the outer flange 219 above the hook bar opening 221.

As with the first embodiment, posts secured to the inner surface of the arms 226 mount an elastic band between the arms that biases the arms against the stops 225.

Because of the arrangement of the straps 227 and 228, straddling the flanges 219 and 220, the arms 226 can be swung to a lower, storage position.

A jack head cage 267 in this embodiment is identical with the cage 67 of the first embodiment.

In operation, the device of the second embodiment is used in exactly the same way as has been described in connection with the first embodiment. It is apparent that the device of the second embodiment can be used with substantially only one diameter of wheel, because it is not equipped with adapters to increase the effective length of the arms. This embodiment can, however, be modified to admit of the use of some type of adapter.

Figure 7:
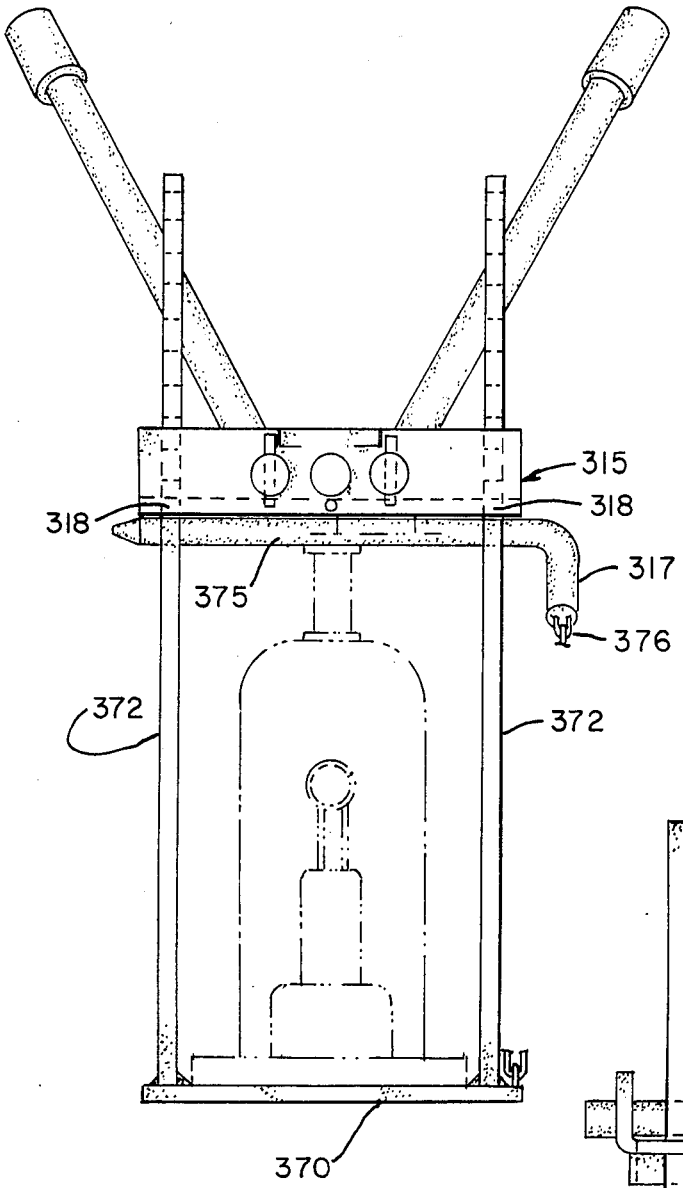
FIG. 7 is a rear elevational view of still another embodiment of wheel bracket assembly of this invention, showing a stand.
Figure 8:
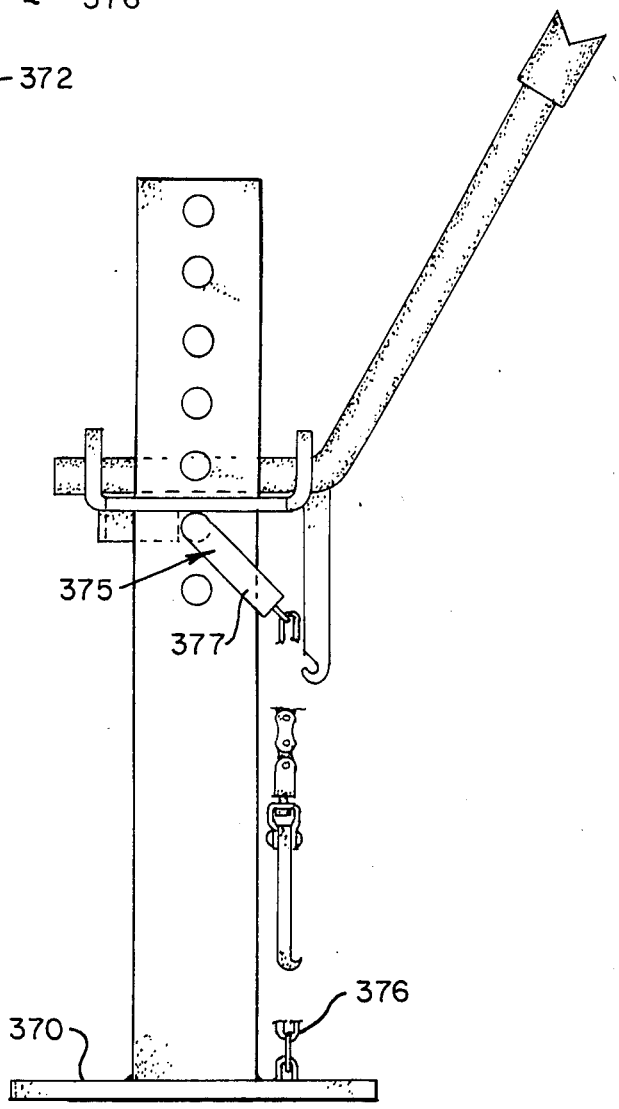
FIG. 8 is a view in side elevation of the assembly of FIG. 7.

Referring now to FIGS. 7 and 8, for still a third embodiment of wheel bracket of this invention, reference numeral 301 indicates a bracket assembly identical with the first embodiment, except that a platform 315 is made wider than the platform 15 of the first embodiment and a central plate 316 is provided, outboard of the arm openings with, a pair of slots 318, sized to receive slidably a pair of spaced, upright stanchions 372. Stanchions 372 are secured at their lower end, as by welding, to a base plate 370. The base plate 370 is wider than the stanchions and the stanchions are spaced apart sufficiently so that a jack can be accommodated to rest on a flat upper surface of the base plate 370, as shown in phantom lines in FIG. 7.

The stanchions 372, in this particular embodiment, are provided with holes 373 aligned as between the stanchions, to receive a retaining pin 375. A keeper chain 376 is shown as secured at one end to the base plate and at the other to a handle portion 377 of the pin 375.

In one illustrative use of the embodiment of device shown in FIGS. 7 and 8, if a sports car or other vehicle with low clearance has a flat tire, the pin 375 is pulled and the platform 315 permitted to drop to the level at which the arms of the bracket assembly can engage the rim of the wheel on which the tire is, as described in connection with the first embodiment. The chain, not here illustrated, is coupled to the web of the wheel, again as in the first embodiment, and a jack, shown in phantom lines in FIG. 7 as being of the hydraulic type, is put in position under the platform. The jack is then operated to raise the wheel until the axle of the car is high enough to permit easy installation of a jack under the axle. The pin 375 is inserted to hold the platform, hence the wheel, in its raised position. If the same jack is to be used, it can be lowered, removed from the stand, and put in place under the axle easily without the operator's having to get down on the ground to work it under the axle. When the vehicle has been jacked up far enough to take the weight off of the arms, the whole assembly can be removed, and the tire changed in the usual way. It is apparent that the same assembly can be used in extricating a vehicle from the mud or the like.

Numerous variations in the construction of the wheel bracket assembly of this invention, within the scope of the appended claims, will occur to those skilled in the art in the light of the foregoing disclosure. Merely by way of illustration and not of limitation, a fan shaped member, either hinged to flanges or tabs perpendicular to the flanges 19 and 20 or secured solidly to the inner edge of the platform, can be used. The outer margin of such a fan-shaped member complementarily to the rim or shaped in such a way that it meets the rim or shaped in such a way that it meets the rim at two, spaced points so as to establish with the hook a lifting plane as is the case with the embodiments in which arms are used. However, the provision of legs has several important advantages. They make the device lighter, more easily stored, and importantly, more versatile in that they can be spread to avoid having to remove wheel weights, for example. They also are more adaptable to the use of extenders like the sleeve adapters 31. Similarly, a fan shaped depending plate, with a series of slots or hooks along its lower edge, can be used instead of the depending hook brackets illustrated in the embodiments shown in FIGS. 1 through 6. Again, the preferred embodiments described have numerous advantages in that they are light, more versatile and easier to use than a fixed plate. Other elastic means can be used in place of the bands 37 and 60, such, for example, as helical springs. The jack-head cage 67 can be constructed differently, as a four sided, open-topped box. In the embodiment shown in FIGS. 7 and 8, retaining means different from the pin 375, such for example, as a ratchet or rack and pawl arrangement can be used. An open-ended guide box can be welded to either side the platform to receive the stanchions, and a ratchet can be contained in the box, similarly to bumper jacks, or a single box can be provided to receive teh upright post of a bumper jack. Although an arrangement in which the platform is not slidably mounted on the stanchions 372 can be used, the stanchions merely straddling the platform outboard of the platform, the preferred embodiment has advantages of safety. In an arrangment in which the stanchions are not fully embraced, the flanges of the platform can be extended beyond the reach of the central plate, to cage the stanchions on three sides and guide the plate. However, this still tends to permit tilting of the stanchions with respect to the plate. Other means for mounting adapter sleeves can be provided on the arms 26 and 27, such, for example, as a reduced cylindrical part at the outer end of the angled sections 30, to provide a shoulder against which a radial surface of the adapter sleeve bears. Different forms of stop members, for limiting the inward movement of the angled sections with respect to one another can be provided, either on the arms themselves or on the platform. These variations are merely illlustrative.

I claim:

1. A vehicle wheel offset wheel bracket assembly for use with a jack comprising a platform having upper and lower surfaces, and two flanges parallel to one another along opposite parallel edges of said platform and projecting above said upper surface of the platform, said lower surface having means for receiving an upper end of a jack, wheel rim engaging means comprising a pair of arms spaced from one another and pivotally mounted on said flanges, said arms having free outer ends to engage a wheel rim above said platform, stop means for limiting movement of the outer end of said arms toward one another to a position at which said arms diverge from one another above said platform in the direction of said wheel, and restraining means carried by said platform and depending below said platform, said restraining means including hook means for engaging a wheel web below said platform.

2. The assembly of claim 1 including connecting means flexible in at least a direction toward said wheel, connecting said platform with said hook means, and means for adjusting the length of said connecting means.

3. The assembly of claim 2 wherein said connecting means is a roller type chain.

4. The assembly of claim 1 including tire-engaging means connected to said platform and extending upwardly therefrom for engaging a tire on said wheel to support said platform before said jack is raised against the platform surface.

5. The assembly of claim 4 wherein said tire engaging means includes a tire hook and a resilient member connected to said tire hook at one end and to said platform at another end.

6. The assembly of claim 1 wherein said arms are round in transverse cross-section and journalled in openings in flanges on said platform.

7. The assembly of claim 1 wherein the arms pivot between a position above the platform for use and below the platform for storage.

8. The assembly of claim 1 including cage means on the underside of said platform for confining the head of a jack raised against said platform within the confines of said cage means.

9. The assembly of claim 2 wherein the means for adjusting the length of the chain comprises a depending bar connected at one end to said platform and extending downwardly therefrom, and a catch at the lower end of said bar, said catch being adapted to engage said chain selectively intermediate its length.

10. The assembly of claim 1 including adapter sleeve means mounted on the outer end of each arm for extending the effective length of each arm, said sleeve means having an outer end adapted to engage said upper rim.

11. The assembly of claim 1 wherein the connecting means comprises a pivotal connection to said platform, the axis of pivoting lying generally in the orientation of the axis of rotation of the wheel.

12. A vehicle wheel offset wheel bracket assembly comprising a platform having upper and lower surfaces and flanges parallel to one another along two edges of said platform and projecting above said upper surface, said lower surface receiving an upper end of a jack, wheel rim engaging means comprising a pair of arms spaced from one another and pivotally mounted on said flanges, said arms having free outer end to engage a wheel rim above said platform, stop means for limiting movement of the outer end of said arms toward one another to a position at which said arms diverge from one another above said platform in the direction of said wheel, restraining means carried by said platform and depending below said platform, said restraining means including hook means for engaging a wheel web below said platform, said arms being swingable about their pivot axes from wheel engaging position at which their outer ends diverge toward the wheel and away from the platform, to a storage position below said platform, and an elastic band connected to and extending between said arms, at a place on said arms between the platform and the outer ends of said arms, holding the arms against said stop means in wheel engaging position, permitting said arms to be rotated about their pivot axes to overcenter said band and the outer ends of said arms to assume a storage position beneath said platform, said band biasing said arms toward one another in said storage position.

* * * * *